US009193089B2

(12) United States Patent
Arnold et al.

(10) Patent No.: US 9,193,089 B2
(45) Date of Patent: Nov. 24, 2015

(54) APPARATUS AND METHOD FOR PROVIDING FILM SHEETS, APPLICATION APPARATUS FOR POPULATING ARTICLES WITH FILM SHEETS

(71) Applicant: ASYS AUTOMATISIERUNGSSYSTEME GMBH, Dornstadt (DE)

(72) Inventors: Achim Arnold, Ulm (DE); Klaus Oppelt, Beimerstetten (DE)

(73) Assignee: ASYS AUTOMATISIERUNGSSYSTEME GmbH, Dornstadt (DE)

( * ) Notice: Subject to any disclaimer, the term of this patent is extended or adjusted under 35 U.S.C. 154(b) by 0 days.

(21) Appl. No.: 14/347,693

(22) PCT Filed: Sep. 21, 2012

(86) PCT No.: PCT/EP2012/003951

§ 371 (c)(1),
(2) Date: Mar. 27, 2014

(87) PCT Pub. No.: WO2013/050110

PCT Pub. Date: Apr. 11, 2013

(65) Prior Publication Data

US 2014/0231484 A1 Aug. 21, 2014

(30) Foreign Application Priority Data

Oct. 7, 2011 (DE) ..... 10 2011 115 942

(51) Int. Cl.
*B26F 3/02* (2006.01)
*B65H 35/00* (2006.01)
*B65H 37/00* (2006.01)

(52) U.S. Cl.
CPC ..... *B26F 3/02* (2013.01); *B65H 35/006* (2013.01); *B65H 35/0013* (2013.01); *B65H 37/002* (2013.01); *Y10T 225/10* (2015.04); *Y10T 225/205* (2015.04)

(58) Field of Classification Search
CPC ..... B65H 35/0013; B65H 35/006; B65H 37/002; B26F 3/02; Y10T 225/10; Y10T 225/205
USPC ..... 225/1, 10, 106, 51, 56, 82, 87, 79, 61, 225/66; 156/60, 540, 577, 578, 584, 541; 226/156; 83/367; 428/41.8, 42.3, 131, 428/137
See application file for complete search history.

(56) References Cited

U.S. PATENT DOCUMENTS 3,237,595 A * 3/1966 Kilham ..... 118/42
3,798,108 A * 3/1974 Ioannilli ..... 156/510

(Continued)

FOREIGN PATENT DOCUMENTS

EP 0755890 A1 1/1997
KR 1020090030368 3/2009
WO WO-2006/039756 A1 4/2006

OTHER PUBLICATIONS

International Preliminary Report on Patentability for International Application No. PCT/EP2012/003951, IB Geneva, issued Apr. 8, 2014.

(Continued)

*Primary Examiner* — Ghassem Alie
(74) *Attorney, Agent, or Firm* — Harness, Dickey & Pierce, P.L.C.

(57) ABSTRACT

An apparatus for providing self-adhesive film sheets includes a film dispenser that provides a film strip with at least one carrier film and a film for use that is self-adhesive on at least one side. A conveying device conveys the film strip from the film dispenser together with the carrier film on a guide track to a removal station, at which the film for use is removed from the carrier film. The removal station has a carriage with a separating edge over which the carrier film can be drawn by the conveying device. An actuator displaces the carrier film along the guide track. The removal station includes a gripper for gripping a film sheet located in front of the separating edge and holding the film sheet stationary while the carriage is displaced on the guide track by the actuator counter to the conveying direction of the carrier film. Simultaneously, the carrier film is drawn away over the separating edge for detachment from the film sheet.

14 Claims, 5 Drawing Sheets

(56) References Cited

U.S. PATENT DOCUMENTS

Figure 1:
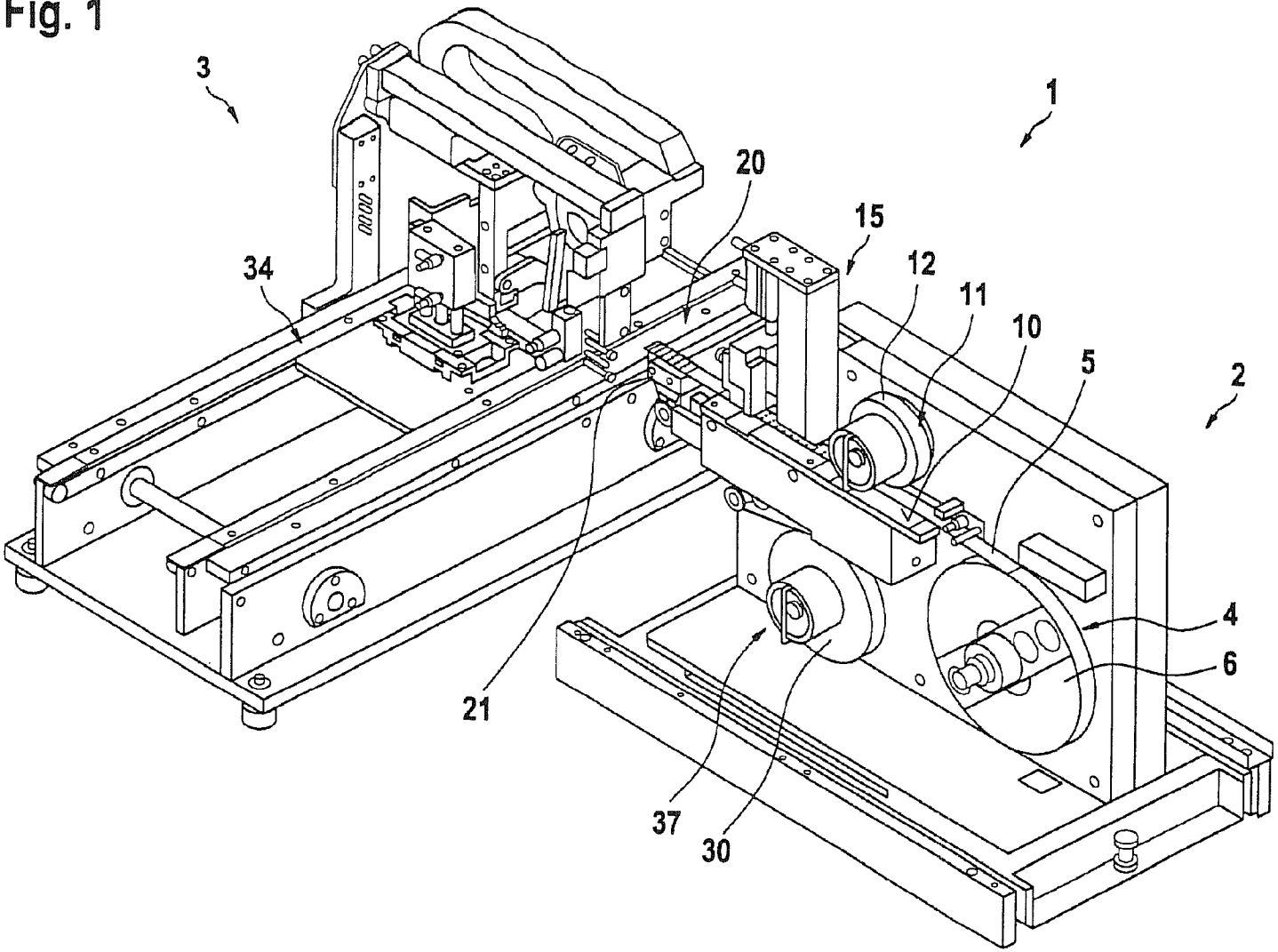

| | | | | |
|---|---|---|---|---|
| 4,718,971 | A * | 1/1988 | Summers | 156/540 |
| 5,286,332 | A * | 2/1994 | Rossini | 156/510 |
| 6,024,148 | A | 2/2000 | Saitoh et al. | |
| 2006/0040085 | A1 * | 2/2006 | Downs et al. | 428/42.3 |
| 2007/0215638 | A1 | 9/2007 | Roche | |
| 2011/0036477 | A1 | 2/2011 | Kato | |
| 2011/0048609 | A1 | 3/2011 | Miyamoto et al. | |

OTHER PUBLICATIONS

International Search Report (English and German) and Written Opinion of the ISA (German) for PCT/EP2012/003951, ISA/EP, Rijswijk, NL, mailed Dec. 19, 2012.

Chinese Office Action in the parallel procedure for Chinese Application No. 201280049407.2, mailed Apr. 3, 2015, with English Translation thereof.

* cited by examiner

APPARATUS AND METHOD FOR PROVIDING FILM SHEETS, APPLICATION APPARATUS FOR POPULATING ARTICLES WITH FILM SHEETS

CROSS-REFERENCE TO RELATED APPLICATIONS

This application is a 371 U.S. National Stage of International Application No. PCT/EP2012/003951, filed Sep. 21, 2012, which claims priority to German Patent Application No. 102011115942.1, filed Oct. 7, 2011. The disclosures of the above applications are incorporated herein by reference.

DESCRIPTION

The invention relates to an apparatus for providing film sheets that are self-adhesive on at least one side, having a film dispenser, which provides a film strip comprising a carrier film and a film for use that is self-adhesive on at least one side arranged thereon, the film for use being divided or divisible into film sheets, a conveying device being provided in order to convey the film strip from the film dispenser together with the carrier film on a guide track to a removal station, at which the film for use is removed from the carrier film.

Furthermore, the invention relates to an application apparatus for populating articles with film sheets that are self-adhesive on at least one side, having a device for providing and positioning the article and having an apparatus for providing the film sheets.

Furthermore, the invention relates to a method for operating such an apparatus.

PRIOR ART

Apparatuses and methods of the type mentioned at the outset are known from the prior art. Corresponding apparatuses are used for example to provide electronic components with a film sheet of a film for use, which protects parts of the component from outside influences or is used for even more comprehensive functions such as heat dissipation. In this connection, using films that are designed to be self-adhesive on at least one side, so that they remain adhered through application to the component itself, is known. To apply the film to the component mechanically and in high quantities, it is also necessary to make corresponding film sheets available. To store a film that is self-adhesive on at least one side, said film is provided with a carrier film on at least the self-adhesive side, which needs to be removed from the film being applied, i.e., the respective film sheet, prior to application thereof. In order to be able to process large quantities of film for use, this is frequently provided in the form of a film strip, which is comprised of at least the carrier film and a film for use arranged thereon and is made available in a rolled-up fashion. The carrier film prevents the adjacent layers of the film for use from coming into contact with each other and adhering to one another. The film strip is normally provided by a film dispenser, from which the film strip is conveyed on a guide track to a removal station by means of a corresponding conveying device, wherein individual film sheets of the film for use are removed from the carrier film at the removal station. Normally, to this end the film sheet is gripped by means of a gripper and peeled off the carrier film so that it can then be applied to the article. In the case of strongly adhesive films for use, the known apparatuses and methods are reaching their limits, because the film sheet cannot be removed very easily from the carrier film.

PROBLEM ADDRESSED BY THE INVENTION

Therefore, the problem addressed by the invention is creating an apparatus for providing film sheets that are adhesive on at least one side, for populating articles with film sheets that are self-adhesive on at least one side and a method for operating such an apparatus, which also makes the provision of and population with film sheets possible, at least one self-adhesive side of which is designed to be strongly adhesive.

DISCLOSURE OF THE INVENTION

The problem addressed by the invention is solved by an apparatus having the features of claim 1. The advantage of the apparatus according to the invention is that the film sheet and carrier film are easily and reliably separated from each other, even if the film for use is designed to be strongly adhesive. To this end, it is provided according to the invention that the removal station have a carriage, which, at the end thereof opposite the film dispenser, has a separating edge, over which the carrier film is drawn by means of the conveying device, and to which an actuator is assigned for displacing said carrier film along the guide track, and wherein the removal station is assigned a gripper which grips a film sheet located in front of the separating edge, as seen in the conveying direction, and holds said film sheet stationary while the carriage is displaced on the guide track by means of the actuator counter to the conveying direction of the carrier film and, at the same time, the carrier film is drawn away over the separating edge for detachment from the film sheet. The removal station thus comprises a carriage, which can be displaced along the guide track and a separating edge. The film strip is therefore conveyed by the film dispenser to the carriage over the separating edge thereof, while the carriage is displaced counter to the conveying direction of the film strip on the guide track. Because the film sheet is being held stationary at this moment by the gripper, the carrier film is able to be pulled off the film for use or the film sheet, in that it is drawn away from the film sheet over the separating edge. The carrier film is drawn away over the separating edge expediently at an angle from the guide track, thereby guaranteeing a simple detachment of the film sheet. The displacement of the carriage and the conveyance of the carrier film are coordinated here such that the carrier film still located on the guide track does not move relative to the film sheet being held stationary so that no shearing forces develop between the film sheet and the carrier film. By peeling off the carrier film from the film sheet by means of the separating edge extending preferably perpendicular to the guide track, the carrier film is instead peeled off the film sheet by means of a low expenditure of force. It is possible in this way to quickly and efficiently make film sheets with at least one strong adhesive film side available. The carriage is expediently moved far in such a way until the film sheet was completely removed from the carrier film, whereupon the gripper can bring the film sheet to an article to be populated with the film sheet. Then the carriage is displaced back into its initial position, wherein the film strip is transported further so that a new film sheet is available in front of the separating edge for removal. The angle is preferably selected such that the film sheet or the film for use detaches by itself from the carrier film due to the inherent rigidity or stiffness of the film for use, if the carrier film is drawn over the separating edge at this angle. In this case, the apparatus can also be provided without the gripper. Wherein means are preferably then present which collect the detached film sheet and make it available for further processing.

The carrier film drawn over the separating edge of the carriage preferably forms an acute angle. The result of this is that the film behind the separating edge, as seen in the conveying direction, is conveyed in the opposite direction, in which it moves on the guide track. Because of the acute angle or the separating edge, which preferably has a corresponding contour with an acute angle or preferably a curvature with a small radius, the carrier film is able to peel off the film sheet in an especially simple manner, in particular without high forces having to be applied, in particular when the angle is selected such that the film for use detaches by itself from the carrier film, as previously described. The acute angle is preferably between 89° and 70°, in particular between 85° and 75°. Naturally, it is also conceivable to provide an obtuse angle; then, however, greater forces are required to peel off the carrier film.

It is preferably provided that the carriage comprises a bearing surface, which ends in particular at the separating edge and forms an end section of the guide track. Therefore, the bearing surface forms a continuation of the guide track over which the film strip with the carrier film is conveyed. Depending upon the position of the carriage, the guide track leads without interruption up to the separating edge or with an interruption, if the carriage is released, or was displaced as seen in the conveying direction. The advantage of providing the bearing surface is that when the gripper is applied to the film sheet in order to grip or grab said film sheet, it can be used with increased force against the film sheet, because the bearing surface supports the film sheet from the other side. The bearing surface ends preferably with the separating edge so that the carrier film rests flat on the bearing surface and does not leave the course of the guide track until after the separating edge, as seen in the conveying direction.

An advantageous further development of the invention provides that the carriage comprises a deflection element, in particular a deflection roller, which is arranged on the side opposite the bearing surface of the carriage, in particular at the height of the bearing surface, as seen in the displacement direction of the carriage, wherein the carrier film is preferably guided from the separating edge directly to the deflection element. The position of the deflection element therefore determines the angle, which the carrier film forms over the separating edge. The design as a deflection roller minimizes frictional forces and makes a simple conveyance of the linear carrier film possible. By assigning the deflection element to the carriage, i.e., by arranging the deflection element on the carriage, the separating angle, i.e., the angle of the carrier film over the separating edge, remains the same in every displacement position of the carriage thereby guaranteeing a uniform peeling off of the carrier film from the film sheet, in particular with constant forces.

In addition, it is preferably provided that the film dispenser is designed as a film strip reel, in particular as a replaceable film. The film strip, consisting of film for use and carrier film, is therefore made available in a rolled-up fashion and is unrolled or withdrawn from the film strip reel to provide individual film sheets.

The conveying device is preferably designed as a tension roller, in particular as a replaceable tension roller, on which the carrier film released from the film for use is wound. The tension roller is assigned a drive device, which puts the tension roller into rotation, in order to convey the carrier film from the film strip reel over the guide track, the carriage and the separating edge. Because the tension roller is replaceable, it is able to be removed as soon as the carrier film of the film strip has been completely removed from a film for use.

An advantageous further development of the invention provides that the film for use is designed to be self-adhesive on two sides. By providing the film strip on the film strip reel both adhesive sides of the carrier film are preferably separated from each other.

However, the film for use is especially preferably arranged between the carrier film and an additionally provided cover film in order to simplify or guarantee an unrolling of the film strip and a corresponding storage or production of the film strip on the film strip reel.

In addition, the apparatus expediently comprises a separating apparatus for removing the cover film, which is preferably arranged between the removal station and the film dispenser. The separating apparatus is especially preferably also designed as a tension roller, on which the cover film removed from the film strip is wound or coiled. The guide track is preferably assigned a separating edge of the separating apparatus, over which the cover film is preferably pulled in an acute angle, as also previously described, from the film for use or from the remaining film strip.

While according to a preferred embodiment, the film sheets of the film for use are already present or arranged in a separated manner on the carrier film or between the carrier film and the cover film, it is provided, according to another preferred embodiment, that the film for use extends linearly over the carrier film and is again divided into individual film sheets prior to reaching the removal station. To this end, the apparatus preferably comprises a separation device, which is preferably arranged between the film dispenser and the removal station, in particular between the separating apparatus and the removal station, and which divides, in particular cuts, the film for use into film sheets without destroying the carrier film. By providing the separation device, it is possible in particular, to vary the film sheet size. The advantage of this is that the same film strip can be made available by means of the apparatus for providing different film sheets, in particular film sheets with different lengths, and therefore for use on different articles. The separation device comprises especially preferably a knife, which can be displaced at least substantially perpendicularly to the guide track, in order to cut the film for use at a desired location. According to a preferred further development of the invention, the knife is held in a modifiable manner in terms of its alignment and/or position, which is why for example one or more actuators are assigned for modifying the positions and/or alignment.

The gripper is advantageously designed as a pneumatically operating gripper or as a suction device, which especially preferably suctions the respective film sheet for holding. If the film sheet is designed to be self-adhesive on two sides, then the effective direction of the pneumatically operating gripper for detaching the film sheet is changed so that the film sheet is blown away or removed/detached from the gripper by means of an air pressure impulse.

The actuator displacing the carriage is preferably designed as a pneumatically or hydraulically operating actuator, in particular as a piston actuator. The piston actuator expediently comprises a cylinder and a piston, wherein the axially displaceable piston is connected to the carriage for displacement thereof. Guide rails, on which the carriage can be displaced in a translatory manner, are expediently provided along the guide track to guide the carriage.

The apparatus for populating articles having the features of claim 13 is characterized by an apparatus for providing film sheets that are self-adhesive on at least one side, as was described in the foregoing. According to an advantageous further development of the invention, the gripper of the removal device is arranged on the apparatus for populating the articles, wherein the apparatus and the device preferably constitute side-by-side machines, and the gripper takes the film sheet and conveys it to the article as soon as the carrier film has been removed. Because of the arrangement of the gripper on the device for providing and positioning the articles, it is possible to exactly determine the gripper position with respect to the articles.

The method according to the invention with the features of claim 14 is characterized in that, to separate the film sheet from the carrier film, the carriage is displaced counter to the conveying direction of the carrier film on the guide track and, at the same time, the carrier film is drawn over the separating edge in order to detach the carrier film from the film sheet. The two processes are preferably coordinated such that no shearing stress develops between the carrier film and the film for use or the film sheet. In other words, the conveying speed of the film strip or the carrier film and the displacement speed of the carriage are selected in such a way that when pulling off the carrier film from the film sheet no relative movement develops in the direction of the guide track between the film sheet and the carrier film. Because of this, a secure and energy-saving detachment of the carrier film from the film sheet or the film sheet from the carrier film is offered.

Figure 2:
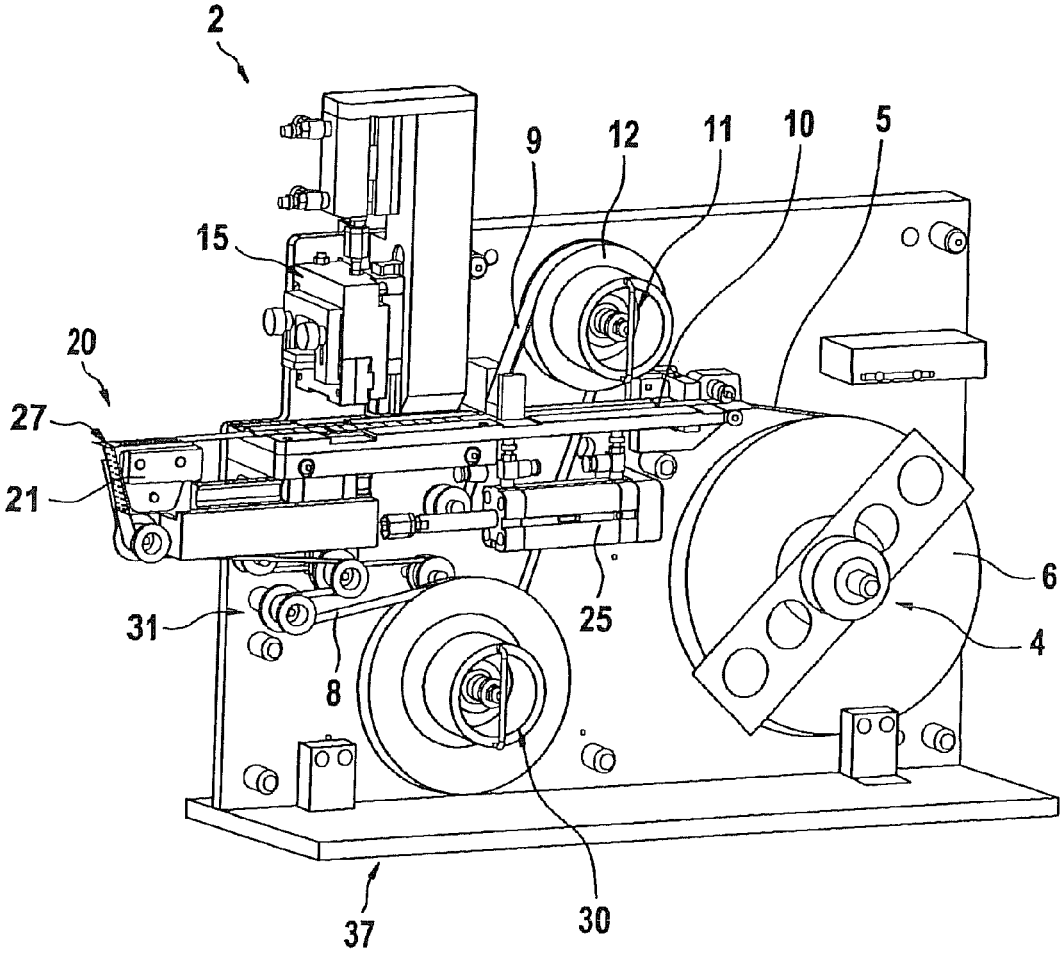
Figure 3:
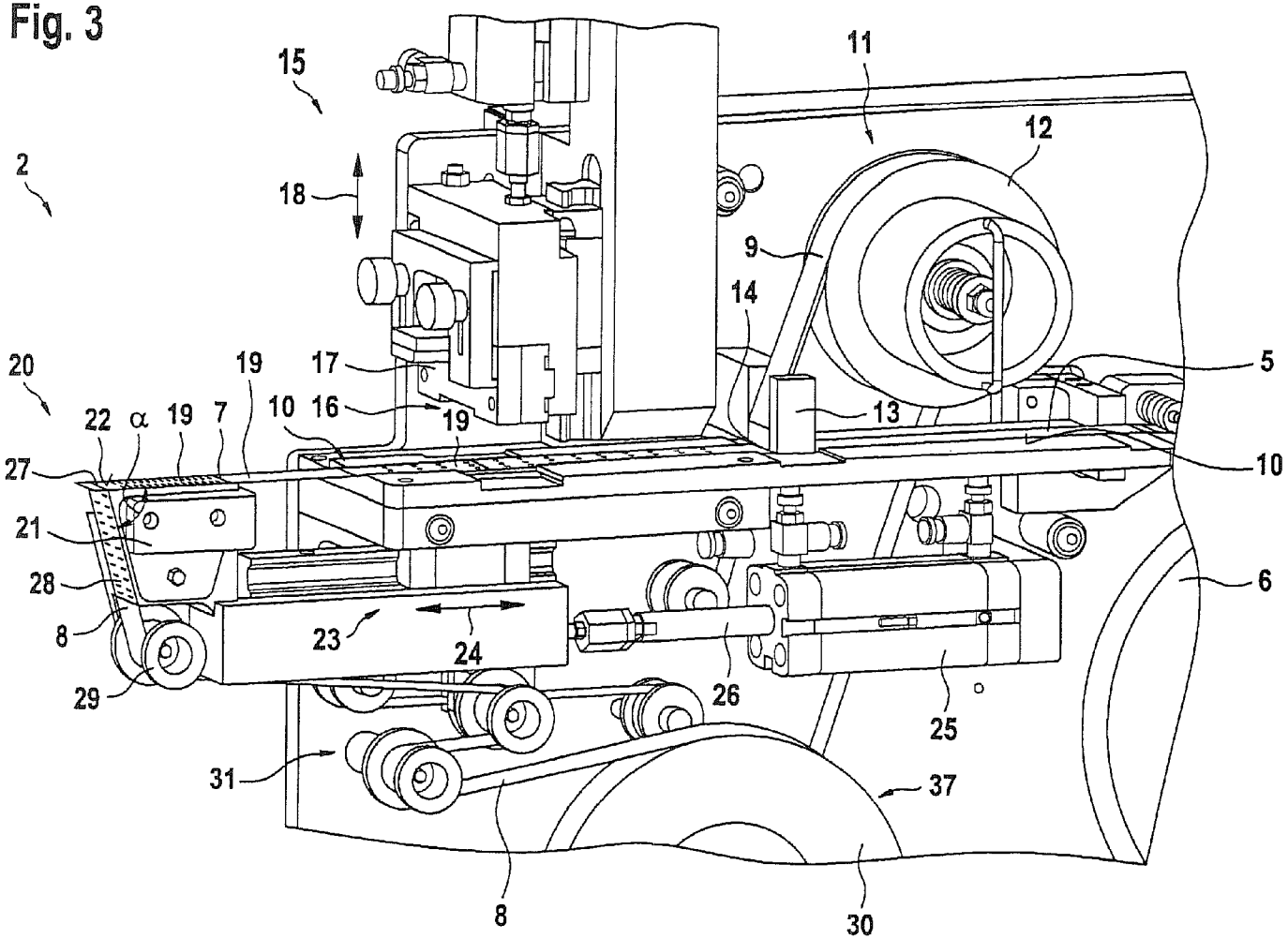
Figure 4:
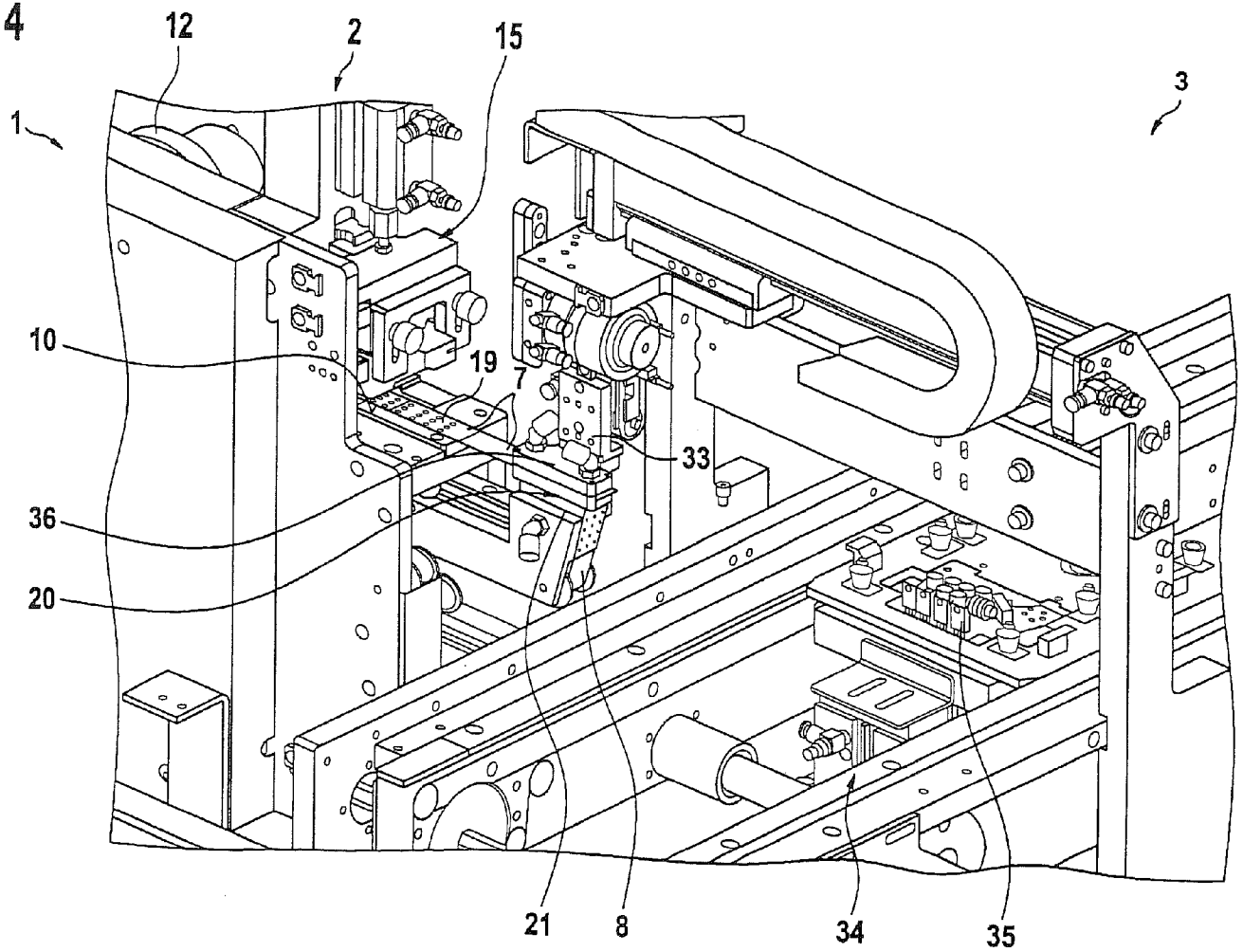
Figure 5:
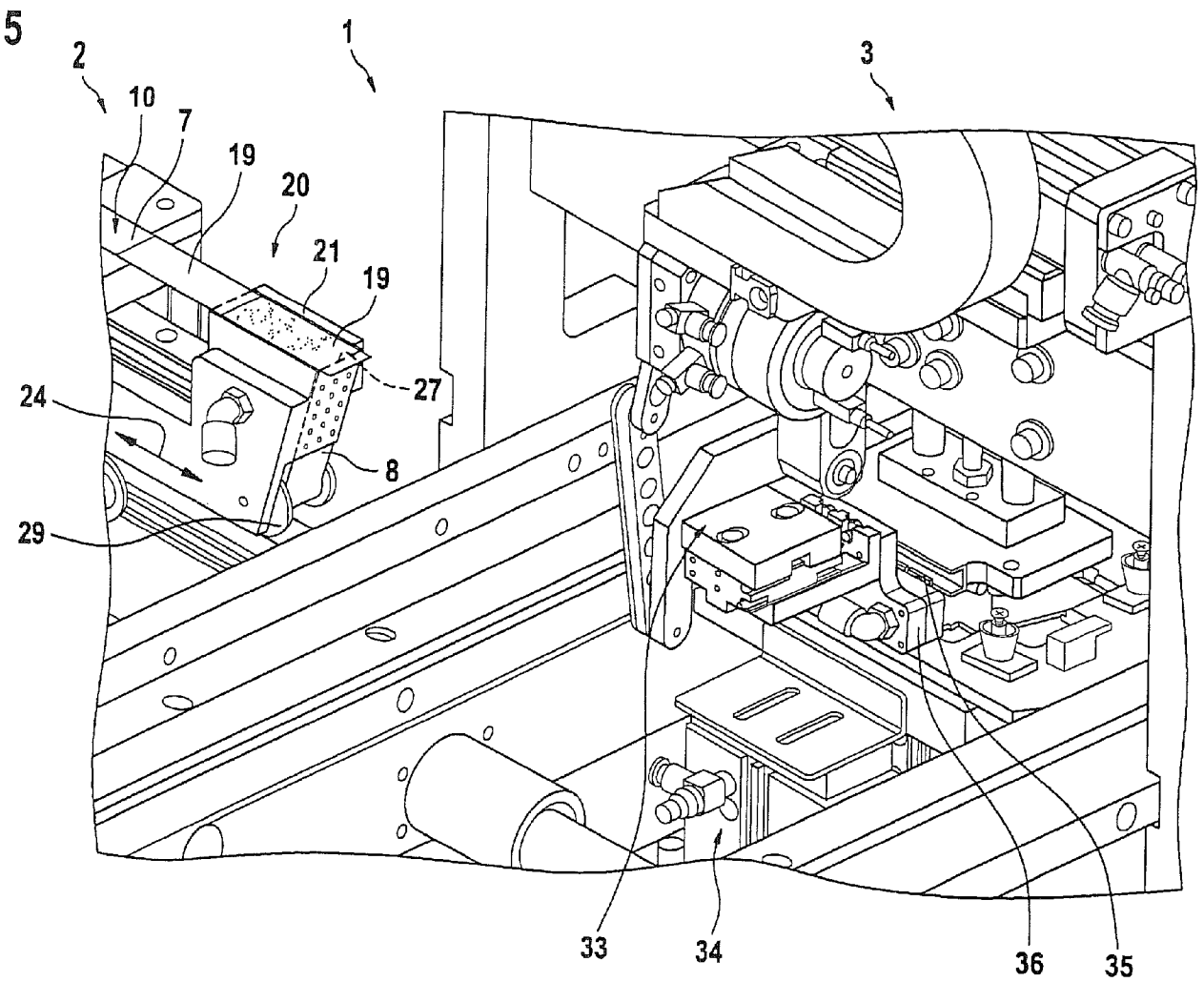

The invention is supposed to be explained in more detail in the following on the basis of the drawings, which show:

FIG. 1 An application apparatus for populating articles with self-adhesive film sheets which are self-adhesive on at least at one side FIG. 2 An apparatus for providing the film sheets FIG. 3 An enlarged representation of the apparatus for providing the film sheets FIG. 4 The application apparatus from another perspective in a first operating position, and FIG. 5 The application apparatus from FIG. 4 in a second operating position.

FIG. 1 shows a perspective representation of an application apparatus 1 for populating articles with self-adhesive film sheets. The application apparatus 1 populates for example electrical/electronic components with film sheets of a thermal conductive film that is used for better heat dissipation and is adhered to elements to be cooled for example and, if applicable, also on a heat sink in order to conduct the heat from the elements to the heat sink.

The application apparatus 1 comprises an apparatus 2 for providing the film sheets and a device 3 for providing and positioning the article(s). The apparatus 2 is supposed to be explained in more detail based on FIGS. 2 and 3. For this purpose, FIG. 2 shows a perspective representation of the apparatus 2, and FIG. 3 shows an enlarged section of FIG. 2 for the sake of clarity.

The apparatus 2 comprises a film dispenser 4, which is used to dispense a film strip 5. For this purpose, the film dispenser 4 is designed as a film strip reel 6, on which the film strip 5 is wound. The film strip 5 is designed here to have three layers, wherein a film for use 7, which is a thermal conductive film in the present exemplary embodiment, is located between a carrier film 8 and a cover film 9, as shown best in FIG. 3. The film for use 7 is designed to be self-adhesive on both sides so that the carrier film 8 and the cover film 9 adhere thereto. Providing the cover film 9 and carrier film 8 makes it possible for the film for use 7 to be stored without a problem in a rolled-up fashion on the film strip reel 6 or to unroll from said reel. According to the present exemplary embodiment, the film for use 7 along with the carrier film 8 and the cover film 9 are designed as a continuous strip.

The film strip 5 is conveyed by the film dispenser 4 on a flat guide track 10, wherein it lies flat with the carrier film 8 on the guide track. In the process, the film strip 5 first passes through a device 11 for removing the cover film 9. The device 11 comprises a tension roller 12 and a deflection element 13, which is assigned to the guide track 10 such that the film strip 5 is pulled through between the deflection element 13 and the guide track 10. The deflection element 13 comprises a separating edge 14. The cover film 9 is steadily peeled off the film strip 5 or the film for use 7 through the in particular motor-driven tension roller 12, wherein the separating edge 14 makes sure that the cover film 9 detaches easily from the film for use 7, in particular utilizing the stiffness of the film for use 7, even if it has a high adhesion value on the side facing the cover film 9.

The remaining film strip 5, consisting of the carrier film 8 and the film for use 7, is conveyed further along the guide track 10 to a separation device 15. The separation device 15 comprises a cutting knife 16 that is displaceable perpendicularly to the guide track 10, and is held in a knife receptacle 17 such that it extends over the entire width of the guide track 10 or of the film strip 5. The knife receptacle 17 is assigned an actuating element, which makes possible at least a displacement of the knife edge in the direction of the film strip 5 and back, in particular perpendicularly to the plane of the guide track 10, as indicated by the double arrow 18. In another embodiment not shown here, the actuating element can also be designed such that the knife edge rotates in terms of its alignment in order to produce an oblique cut with respect to the film strip for example. However, the actuating element is at least designed such that, in the case of a cutting process, the knife 16 is displaced only far enough for just the film for use 7, but not the carrier film 8, to be separated. For this purpose, the knife receptacle 17 or the separation device 15 comprises in particular corresponding limits stops, which indicate in a form-fitting manner a minimum distance of the knife edge of the knife 16 to the guide track 10. Cutting the film for use 5 produces separate film sheets 19, which are conveyed further adhering to the carrier film 8.

Following the separation device 15, as seen in the conveying direction, is a removal station 20, which comprises a carriage 21. The carriage 21 comprises a bearing surface 22, which forms an end section of the guide track 10. For this purpose, the bearing surface 22 lies in the plane of the guide track 10. The carriage 21 is held in the process on the underside of the guide track 10 by means of a rail guide 23. The rail guide 23 is designed here such that the carriage 21 can be displaced in the direction of the guide track 10, as indicated by a double arrow 24. For this purpose, the carriage 21 is designed to be substantially L-shaped. An actuator 25 is assigned to the carriage 21 to displace the carriage 21 along the guide track 10. In the present exemplary embodiment, the actuator 25 is designed as a pneumatically operating piston actuator, the axially displaceable piston rod 26 thereof being connected to the carriage 21. If the carriage 21 is displaced up to the limit stop in the direction of the guide track or of the actuator 25, then the guide track 10 is continuous, otherwise the guide track 10 has an interruption.

At the end of the bearing surface 22, as seen in the conveying direction, the carriage 21 has a separating edge 27, over which the carrier film 8 is drawn from the plane of the guide track 10. In the process, the bearing surface 22 and a face surface 28 of the carriage 21 following the separating edge form an acute angle $\alpha$ of approximately 85°. In the depiction beneath the bearing surface 22, the carriage 21 has a deflection roller 29, which is designed and disposed such that the carrier film 8 being drawn over the separating edge 27 rests on the acute angle $\alpha$ following the carriage 21 or the bearing surface 22 and the face surface 28. The carrier film is conveyed further by the deflection roller 29 to a tension roller 30 via a tensioning roller system 31. The beginning of the film strip 5 is fastened to the tension roller 30 so that the film strip is rolled up through a rotation of the tension roller 30 and thereby drawn from the film strip reel 6, over the guide track 10, the carriage 21, the deflection roller 29 and the tensioning roller system 31. The tensioning roller system 31 makes sure in the process that even with a displacement of the carriage 21, the tensile stress in the film strip 5 or in the carrier film 8 is maintained. A common drive is preferably assigned to the tension rollers 30 and 12, which drives the tension rollers, as shown, for example via a belt drive. The tension rollers 12 and 30 therefore form a conveying device 37 in order to convey the film strip 5 from the film dispenser 4 to the removal station 20.

FIG. 4 shows another perspective representation of the application apparatus 1, viewed however from the opposite direction as shown in FIG. 1. The device 3 for positioning and providing the articles, which are supposed to be populated with film sheets of the film for use 7, has a gripping apparatus 32, which comprises a moveable gripper arm 33, which can be moved from the removal station 20 to a conveying device 34 of the device 3 and back. The conveying device 34 conveys the articles 35 to be populated past the apparatus 2. On the end of the gripper arm 33 is a gripper 36, which is designed to operate pneumatically, and, to this end, has a contact surface, which is provided with one, preferably a plurality of openings, in which a suctioning or detaching of a film sheet 19 can be adjusted with pneumatically acting negative pressure or excess pressure. Alternatively, providing the gripper arm 33 on the apparatus 2 is also conceivable.

The functioning of the application apparatus 1 is supposed to be explained in the following:

In order to now populate the component or the article 35 with a film sheet 19, the film strip 5 is first unrolled from the film strip reel 6 by the tension rollers 12 and 30 pulling the cover film 9 or the carrier film 8. In the process, the film strip 5 is unrolled enough in such a way that a film sheet of the desired size is produced by means of the separation device 15 through a cutting process. Then the film strip 5 continues to be unrolled until the film sheet 19 rests on the bearing surface 22 of the carriage 21 and the carriage 21 is situated in its extended position, i.e., in the rear or released position thereof, as seen in the conveying direction of the film strip 5 on the guide track 10. Then the gripper 36 is conveyed to the carriage 21 by means of the gripper arm 33 such that the gripper 36 makes contact with the free upper side of the film sheet 19 and suctions the film sheet 19 in order to hold said film stationary (FIG. 4). Then the carriage 21 is displaced or engaged by means of the actuator 25 in the direction of the separation device 15 or counter to the conveying direction of the film strip 5 on the guide track 10, wherein at the same time, the tension rollers 30 and 12 further roll the carrier film 8 and cover film 9 so that in particular the carrier film 8 is drawn over the separating edge 27 forming the angle $\alpha$, while the film sheet 19 is held stationary by the gripper 36. Displacing the carriage 21 and simultaneously pulling off the carrier film 8, separates or pulls off said carrier film in a simple manner from the film sheet 19, wherein the film sheet 19 detaches from the carrier film 8 due to the angle $\alpha$ at least substantially by itself, when it is drawn over the separating edge 27, as shown for example in FIG. 5. Then the film for use 7 that is now released from the carrier film 8 in the form of the film sheet 19 is brought by means of the gripper arm 33 to the device 3 and is pressed there onto the article 35 at the desired location, where it remains adhering due to the inherent adhesion thereof, when the gripper 36 releases the film sheet 19, for example, by exerting a pneumatic pressure impulse on the film sheet 19 (FIG. 5). Then the process starts again from the beginning, wherein with the subsequent unrolling of the film strip 5, the carriage 21 is once again displaced or released forward, as seen in the conveying direction on the guide track 10, i.e., away from the separation direction 15 in order to bring the subsequent film sheet 19 into the removal position.

Therefore, all in all an apparatus and a method are offered, which make it possible to provide self-adhesive film sheets 19 in the desired size.

As an alternative to the described exemplary embodiment, it is also conceivable to use the system for a film for use, which is self-adhesive only on one side. Then the cover film 9 and also the tension roller 12 for example could be dispensed with.

The invention claimed is:

1. An apparatus for providing film sheets that are self-adhesive on at least one side, the apparatus comprising:

a film dispenser for providing a film strip having at least one carrier film and a film for use that is self-adhesive on at least one side arranged thereon, the film for use being divided or divisible into film sheets; and a conveying device for conveying the film strip from the film dispenser together with the carrier film on a guide track; and a removal station, for receiving the film strip together with the carrier film from the guide track and for removing the film for use from the carrier film, the removal station having a carriage which, at the end thereof opposite the film dispenser, has a separating edge, over which the carrier film can be drawn by the conveying device, and to which an actuator is assigned for displacing the carrier film along the guide track;

wherein the removal station is assigned a gripper which grips a film sheet located in front of the separating edge, as seen in a conveying direction, and holds the film sheet stationary, while the carriage is slidingly displaced on a rail structure of the guide track by the actuator counter to the conveying direction of the carrier film and, at the same time, the carrier film is drawn away over the separating edge for detachment from the film sheet.

2. The apparatus according to claim 1, wherein the carrier film drawn over the separating edge of the carriage forms an acute angle.

3. The apparatus according to claim 1, wherein the carriage comprises a bearing surface, which ends in particular at the separating edge and forms an end section of the guide track.

4. The apparatus according to claim 1, wherein the carriage comprises a deflection element, in the form of a deflection roller arranged on a side opposite the bearing surface of the carriage at a height of the bearing surface, as seen in the displacement direction of the carriage.

5. The apparatus according to claim 1, wherein the film dispenser is a replaceable film strip reel.

6. The apparatus according to claim 1, wherein the conveying device includes at least one replaceable tension roller on which the carrier film released from the film for use is wound.

7. The apparatus according to claim 1, wherein the film for use is self-adhesive on two sides.

8. The apparatus according to claim 1, wherein the film for use is arranged between the carrier film and a cover film.

9. The apparatus according to claim 1, further comprising a separating apparatus for removing the cover film between the removal station and the film dispenser.

10. The apparatus according to claim 1, further comprising a separation device arranged between the film dispenser and the removal station, for dividing the film for use into film sheets.

11. The apparatus according to claim 1, wherein the gripper is a pneumatically operating gripper.

12. The apparatus according to claim 1, wherein the actuator is selected from a group consisting of a pneumatically opening piston actuator and a hydraulically operating piston actuator.

13. The apparatus for providing film sheets of claim 1, in combination with a device for providing and positioning articles to be populated with the film sheets.

14. A method for operating the apparatus according to claim 1, the method comprising separating the film sheet from the carrier film by displacing the carriage counter to the conveying direction of the carrier film on the guide track and, at the same time, drawing the carrier film over the separating edge in order to detach the carrier film from the film sheet.

* * * * *